US005398342A

United States Patent [19]

Kinnee et al.

[11] Patent Number: 5,398,342

[45] Date of Patent: Mar. 21, 1995

[54] AIR MANAGEMENT BASEBALL GLOVE

[75] Inventors: Bruce E. Kinnee, San Ramon; Michael F. Zlaket, San Francisco, both of Calif.; Reginald C. Phippen, Salt Lake City, Utah

[73] Assignee: Easton Sports, Burlingame, Calif.

[21] Appl. No.: 265,509

[22] Filed: Jun. 24, 1994

Related U.S. Application Data

[63] Continuation of Ser. No. 880,733, May 6, 1992, abandoned.

[51] Int. Cl.[6] ..... A41D 13/10

[52] U.S. Cl. ..... 2/19; 2/20; 2/161.1

[58] Field of Search ..... 2/19, 20, 161 A, 21, 2/16, 267, 161 R, 161.1, 161.6, 2

[56] References Cited

U.S. PATENT DOCUMENTS

| | | | |
|---|---|---|---|
| 950,083 | 2/1910 | Waring | 2/19 |
| 962,438 | 6/1910 | King | 2/19 |
| 4,441,211 | 4/1984 | Donzis | 2/69 |
| 4,486,901 | 12/1984 | Donzis | 2/2 |
| 4,513,449 | 4/1985 | Donzis | 2/2 |
| 4,630,318 | 12/1986 | Aoki | 2/19 |
| 4,700,403 | 10/1987 | Vacanti | 2/2 |
| 4,926,503 | 5/1990 | Wingo, Jr. | 2/267 |
| 4,985,931 | 1/1991 | Wingo, Jr. | 2/2 |

*Primary Examiner*—Clifford D. Crowder
*Assistant Examiner*—Amy B. Vanatta
*Attorney, Agent, or Firm*—Flehr, Hohbach, Test, Albritton & Herbert

[57] ABSTRACT

A baseball glove for protecting a hand and for enabling the wearer to catch a ball. The glove includes a front panel having inner and outer plies and a back panel joined to the front panel. A pad of open cell foam material is disposed between the inner and outer plies. The pad, which includes first and second opposed surfaces and an edge surface, has the major portion of the pad surfaces rendered impervious to the flow of air. One or more vents in at least one of the pad surfaces provides for the passage of air therethrough at a rate allowing the pad to substantially absorb the force of impact of a ball.

28 Claims, 2 Drawing Sheets

AIR MANAGEMENT BASEBALL GLOVE

This is a continuation of application Ser. No. 08/880,733, filed on May 6, 1992, now abandoned.

BACKGROUND OF THE INVENTION

1. Field of the Invention

In general, the present invention relates to a baseball glove. More particularly, the present invention relates to a glove worn to protect a hand from the force of impact of a ball.

2. Description of the Prior Art

A baseball glove is worn to enable the wearer to catch a ball and to reduce the force of impact. The glove protects the wearer's hand by absorbing some of the force imparted by the ball. Baseball gloves traditionally have padding built into the palm of the glove for reducing the force of impact. The padding cushions the blow delivered by the ball, protecting the wearer from pain and injury.

Various materials, such as felt or cotton, have traditionally been used as padding in baseball gloves. The amount of cushioning provided is dependent upon the type and thickness of the padding material. With the demand for a greater degree of protection, the thickness of the padding in baseball gloves has been increased. While improving the ability of the glove to absorb the force of impact, the increased thickness interferes with the wearer's ability to catch a ball.

A baseball glove substantially increases the catching area of a wearer's hand. The glove must be somewhat flexible, enabling the wearer to effectively manipulate the glove. When the wearer feels the ball strike the glove, he must quickly bring the edges of the glove around the ball to prevent it from dropping to the ground. Similarly, the player must be able to efficiently release the ball and transfer it to his other hand.

Increasing the amount of padding material provided in the baseball glove sacrifices the amount of control the wearer will have when catching a ball. The thicker glove is more difficult to manipulate, interfering with the wearer's ability to retain the ball. The feel of the ball is substantially diminished by the thicker padding, increasing wearer's reaction time to the impact of the ball. Although the additional padding more effectively absorbs the force of impact, the reduced flexibility and increased response time significantly reduces the wearer's ability to catch a ball. A baseball glove which substantially absorbs the force of impact imparted by the ball while maximizing the wearer's control for catching a ball is desirable.

A pad for a baseball glove having improved protective advantages and the control found with the traditional thin pads of felt or cotton is desirable. A pad offering a greater degree of control than is available with traditional padding materials while substantially absorbing the force of impact would be particularly valuable.

SUMMARY OF THE INVENTION

Accordingly, a primary object of the present invention is to provide a baseball glove for protecting the wearer's hand when catching a ball.

A further object of the present invention is to provide a baseball glove offering a substantial degree of control when catching a ball.

Another object of the present invention is to provide a baseball glove which may be easily manipulated by the wearer to catch and retain a ball.

Yet another object of the present invention is to provide a baseball glove which protects a hand from injury while allowing the wearer to quickly respond to the impact of a ball.

A more general object of the present invention is to provide a baseball glove which is efficiently manufactured, and which is comfortable to wear.

In summary, the baseball glove of the present invention includes a front panel having an inner ply and an outer ply. A back panel is joined to the front panel, with the front and back panels defining a pocket formed to receive a hand. A pad of open cell foam is positioned between the inner and outer plies of the front panel. The pad, having first and second opposed surfaces and an edge surface, is formed with the major portion of the surfaces rendered impervious to the flow of air. One or more vents in at least one of the surfaces provides for the passage of air. When a ball strikes the pad, air travels through the open cell foam and passes through the vents at a rate allowing the pad to substantially absorb the force of impact.

In one aspect of the present invention, the pad is formed and positioned between the inner and outer plies for covering the palm of a hand wearing the glove. The pad is further formed and positioned for partially covering at least one finger. The pad thereby provides an expansive area of open cell foam, with the displacement of air to outlying areas of the foam material substantially absorbing the force of impact. Thus, when catching a ball the pad is compressed at the point of impact, air is driven at a controlled rate through the open cell foam to remote areas within the pad and through the vents.

BRIEF DESCRIPTION OF THE DRAWINGS

Additional objects and features of the present invention will be more apparent from the following detailed description and the appended claims, when taken in conjunction with the drawings, in which:

DETAILED EMBODIMENT OF THE INVENTION

Figure 1:
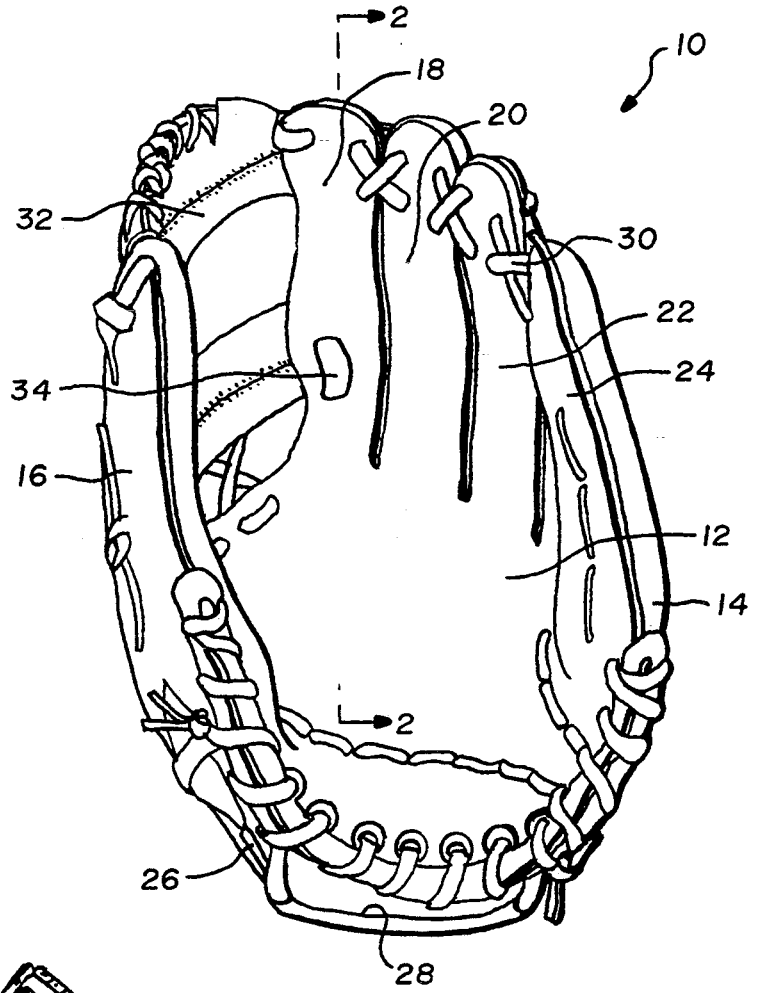
FIG. 1 is a front perspective view of a glove made in accordance with the present invention.

Reference will now be made in detail to the preferred embodiment of the invention, which is illustrated in the accompanying figures. Turning now to the drawings, wherein like components are designated by like reference numerals throughout the various figures, attention is directed to FIGS. 1–3.

Figure 2:
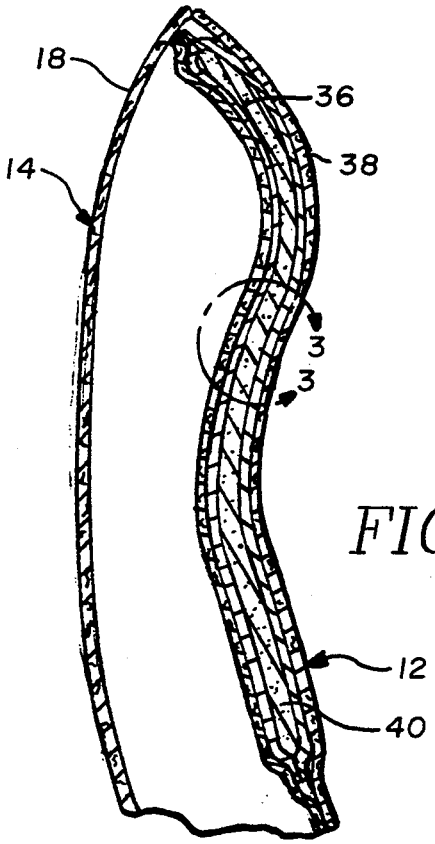
FIG. 2 is a cross sectional view taken along line 2—2 of FIG. 1.
Figure 3:
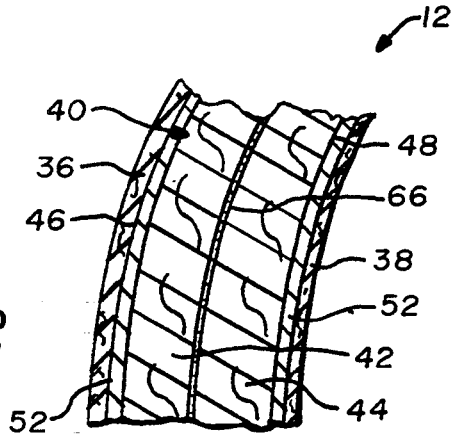
FIG. 3 is an enlarged cross section view taken at the area designated 3—3 in FIG. 2.

A baseball glove 10 incorporating the present invention is shown in FIGS. 1–3. The baseball glove generally includes a front panel 12 and a back panel 14. The front and back panels are joined together by stitching substantially along the major portion of the perimeter of the panels, forming a pocket for receiving a hand. A plurality of sleeves, thumb section 16 and finger sections 18, 20, 22 and 24, are defined by panels 12 and 14 and are formed for receiving the digits of a hand. An adjustable wristband 26 extends across the lower portion of back panel 14. The lower edge of front panel 12 and the wristband define an opening 28 formed for receiving a hand. Once a hand has been inserted into the glove, the wearer may adjust the size of the opening for maximum comfort and control using the wristband.

In the present embodiment, the finger sections are coupled together along the upper edge by crossed thongs 30. Webbed portion 32 flexibly attaches thumb section 16 to finger section 18 with thong 34. Connecting the upper portion of the sleeves together guarantees efficient opening and closing movements, enhancing the wearer's control over the glove and improving his ability to manipulate the glove to retain a ball.

Turning to FIGS. 2 and 3, front panel 12 includes inner and outer plies 36 and 38. A pad 40 is disposed between the inner and outer plies. The pad substantially absorbs the force of impact of a ball striking the glove, protecting the hand from pain and potential injury. Traditionally, several types of padding have been used between the inner and outer plies to cushion the blow of the ball. However, with the glove of the present invention, the pad is formed to substantially absorb the force of impact while providing the wearer with maximum control.

Pad 40 is of an open cell foam material preferably having a density of about one pound per cubic foot. The open cell foam is of particular advantage with the present invention. Air freely travels through the material, and the cell structure is not destroyed when the material is compressed. In the present embodiment, the pad is formed with first and second layers 42 and 44 of foam material having the same density. The total thickness provided by the two layers is preferably about one-half an inch. However, depending upon the amount of wearer control and shock absorption desired, pad 40 may be formed having other thicknesses. Similarly, a single layer, or several layers of foam material may be provided in the pad. In addition, the layers may be formed of a foam material having different densities.

Figure 4:
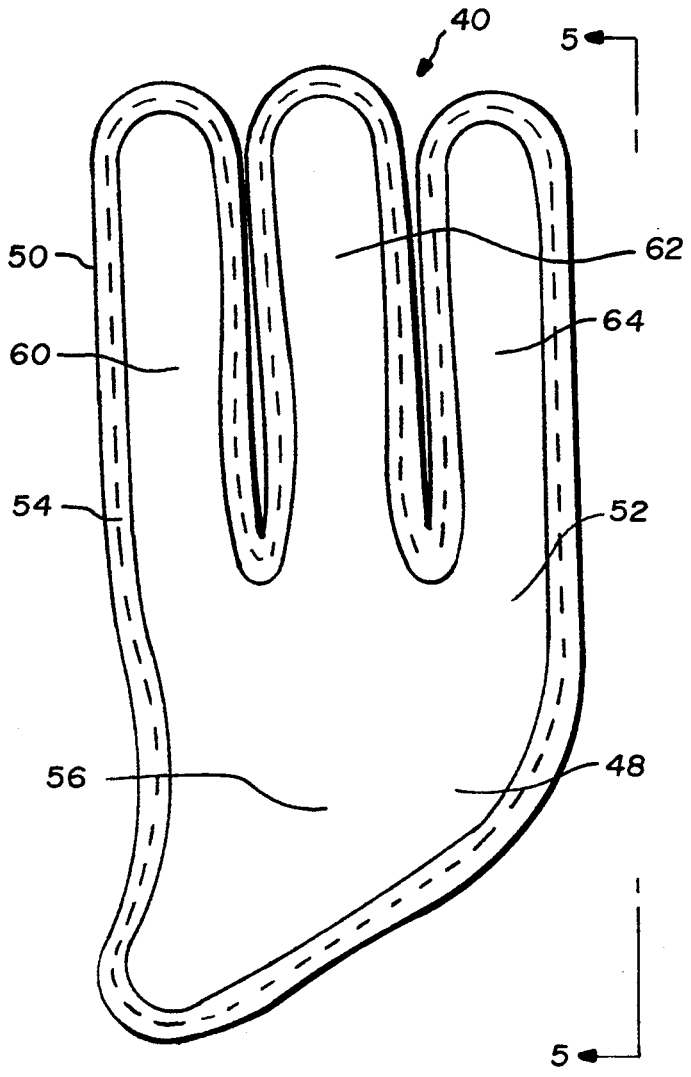
FIG. 4 is a top plan view of the pad of a glove made in accordance with the present invention.
Figure 5:
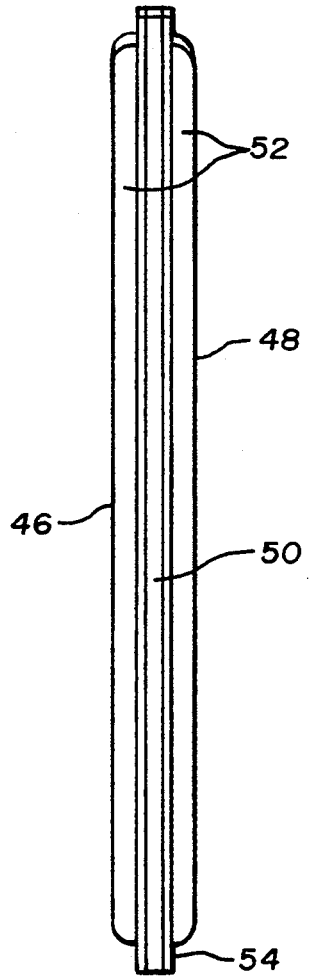
FIG. 5 is an end plan view taken along line 5—5 of FIG. 4.

As is shown particularly in FIGS. 4 and 5, pad 40 has first and second opposed surfaces 46 and 48 and a peripheral edge 50. The pad includes means for rendering the major portion of the pad surfaces impervious to the flow of air. One such means is a nylon material 52 adhered to the surfaces 46 and 48 by an impervious adhesive. Covering a major portion of the foam material with impervious material 52 substantially limits the flow of air into and out of the first and second layers 42 and 44. For effectiveness in absorbing the force of impact, air must pass from the foam material at a controlled rate. If air were to freely escape, the foam would become substantially compressed without reducing the impact of the ball. On the other hand, rendering pad 40 completely airtight will trap the air, the foam material will not be compressed and the pad will not absorb the force of impact.

Pad 40 includes vent means, such as binding or vent material 54 about the periphery of the pad. The vent material provides passage for the flow of air. When a ball strikes the pad, air will travel through the open cell foam and escape through the binding, which is formed of a material pervious to the flow of air. The binding has a texture restricting the flow of air to a rate allowing the pad to substantially absorb the force of impact. Air is thereby allowed to pass through the binding, but at a relatively slow rate. The vent material may be uniformly pervious to air; or alternatively, it may be generally impervious but with openings therethrough of sufficient size and number to permit limited movement of air therethrough.

The binding material 54 covers the edges of impervious material 52 adjacent edge 50. The texture of the material 54 provides a vent for the passage of air through the edge 50 from the open cell foam at a restricted flow rate. The binding substantially extends along the edge 50, providing an air passage continuing around the perimeter of the pad. When a ball strikes the pad, air is driven radially from the point of impact. Providing a passage for air substantially around the perimeter ensures that, even when the point of impact is located adjacent an edge of the pad, air will be effectively removed from the impact point.

In the present embodiment, the impervious material 52 is a polyurethane coated nylon 'which is sensitive to heat. The nylon material is bonded to the surfaces 46 and 48 with an adhesive substance; or alternatively through the application of heat. Other materials impervious to the flow of air may be substituted for the coated nylon. Similarly, the impervious material may be bonded to opposed surfaces 46 and 48 using any suitable method. Binding 54 is a nylon material pervious to the flow of air. However, other forms of passage may be substituted for the binding material. For example, apertures or pores may be formed in a material substantially impervious to the flow of air. The nylon material of the present invention may be replaced by other materials or fabrics pervious to the flow of air. If desired, the fabric may be chosen having a texture further restricting the flow of air, or alternatively allowing the air to pass through at a faster rate than that of the nylon material.

As is shown particularly in FIG. 4, pad 40 is shaped having a palm portion 56, a thumb portion 58 and finger portions 60, 62 and 64. When disposed between inner and outer plies 36 and 38, the palm portion is positioned to cover the palm of a hand, the thumb portion partially extends along thumb section 16, and the finger portions stretch along finger sections 18, 20 and 22. Pad 40 covers a substantial area of front panel 10. Extending the pad beyond the palm area provides a greater area of open cell foam through which displaced air may travel. Thus, when a ball strikes palm portion 56, air will travel towards thumb portion 58, along the finger portions, and through binding 54. This improves the response of the pad to a ball, allowing the pad to substantially absorb the force of impact. Pad 40 additionally protects the fingers and thumb of the wearer's hand by absorbing the force of a ball striking the finger and thumb portions of the pad. Thus, the wearer's hand is protected even when the ball strikes areas other than the palm of the glove.

To permit air to transfer between first and second layers 42 and 44 the layers are joined together by the application of an air pervious adhesive substance 66 (FIG. 3). The adhesive substance is pervious to the flow of air, thereby allowing air to flow freely between the two layers. In other embodiments of the present invention, the multiple layers of foam material may not be joined together, reducing the cost of manufacture.

Joining impervious material 52 to opposed surfaces 46 and 48, and securing first and second layers 42 and 44 together provides pad 40 with a unitary construction which substantially enhances the wearer's control over the glove. The pad does not interfere with the opening and closing of the glove. Instead, air within the pad moves throughout the open cell foam as the pad conforms to the movements of the wearer's hands. Thus, the glove of the present invention has the increased protection of the thicker padding combined with the control available with a thin pad.

The pad 40 of the present invention is particularly suitable for providing a significant amount of glove control while substantially absorbing the force of impact of a ball. When a ball strikes the pad, the foam material compresses, driving air through the open cell foam and the binding. The transfer of air substantially absorbs the force of impact. The partially compressed pad enables the wearer to sense the true feel of the ball, reducing the wearer's response time and increasing his efficiency in removing the caught ball from the glove.

The present invention has been described in relation to a baseball glove having defined sleeves for the thumb and fingers. However, it is to be understood that the foregoing discussion applies equally to a catcher's glove and other gloves without finger and thumb sections. For the catcher's glove, the pad would similarly be formed without defined finger portions, but would instead have any other suitable shape.

What is claimed is:

1. A baseball glove comprising:

(a) a flexible front panel having an inner ply and an outer ply;

(b) a flexible back panel joined to said front panel, said front and back panels defining a pocket formed to receive a hand; and (c) a pad of open cell foam material disposed between said inner and outer plies, said pad being flexible for substantially absorbing the force of impact of a ball striking said pad and sufficiently pliant for manipulation of said glove by a wearer upon application of minimal force to said pad by the wearer, said pad having first and second opposed surfaces and an edge surface, means for rendering the major portion of said pad surfaces impervious to the flow of air, vent means in at least one of said pad surfaces for providing passage for air therethrough at a rate such that in response to the impact of a ball striking said pad, air travels from the point of impact through said open cell foam and is released from said pad through said vent means at a rate allowing said pad to substantially absorb the force of impact of said ball.

2. A baseball glove as defined in claim 1 wherein said pad surfaces rendered impervious to the flow of air by said rendering means include said first and second opposed surfaces.

3. A baseball glove as defined in claim 1 wherein said vent means is in said edge surface.

4. A baseball glove as defined in claim 1 wherein said pad is formed and positioned between said inner and outer plies for covering the palm of a hand inserted into said pocket, said pad further being formed and positioned for at least partially extending along at least one of the fingers of said hand.

5. A baseball glove as defined in claim 1 wherein said front panel includes a palm portion for covering the palm of a hand, and wherein said pad is disposed between said plies adjacent said palm portion.

6. A baseball glove as defined in claim 5 wherein said front and back panels are further joined together defining a plurality of sleeves formed to receive the digits of a hand, said pad extending between said inner and outer plies at least partially along at least one of said sleeves.

7. A baseball glove as defined in claim 1 wherein said pad has first and second layers of said open cell foam material.

8. A baseball glove as defined in claim 1 wherein said rendering means includes a material impervious to the flow of air applied to the major portion of said pad surfaces for preventing the flow of air therethrough.

9. A baseball glove as defined in claim 8 wherein said impervious material is bonded to said pad surfaces.

10. A baseball glove as defined in claim 8 wherein said impervious material is a nylon material.

11. A baseball glove as defined in claim 1 wherein said vent means includes a vent material pervious to the flow of air applied along at least one of said pad surfaces, said vent material having a construction providing for the passage of air therethrough at a controlled rate such that when a ball strikes said pad, said pad substantially absorbs the force of impact of said ball.

12. A baseball glove as defined in claim 1 wherein said open cell foam material has a density of approximately one pound per cubic foot.

13. A baseball glove as defined in claim 1 wherein said pad has a thickness of approximately one-half an inch.

14. A baseball glove comprising:

(a) a pad of at least first and second layers of open cell foam material for absorbing the force of impact of a ball, said pad having first and second opposed surfaces and an edge surface, means for rendering the major portion of said pad surfaces impervious to the flow of air, vent means in at least one of said pad surfaces for providing passage for air therethrough, said pad being sufficiently flexible and pliant for manipulation of said glove by a wearer upon application of minimal force to said pad by the wearer;

(b) a flexible front panel having an inner ply and an outer ply formed to receive said pad therebetween;

(c) a flexible back panel joined to said front panel, said front and back panels defining a pocket formed to receive a hand; and (d) said pad extending between said inner and outer plies such that when said ball strikes said pad, said pad substantially absorbs the force of impact of a ball striking said pad by compressing at the point of impact and by air travelling through said open cell foam to areas remote from the compressed portion of said pad and through said vent means at a rate allowing said pad to substantially absorb the force of impact of said ball.

15. A baseball glove as defined in claim 14 wherein said pad includes an adhesive substance securing said first and second layers together, said adhesive substance being pervious to the flow of air therethrough whereby air may freely pass between said first and second layers.

16. A baseball glove as defined in claim 14 wherein said first and second layers have the same density.

17. A baseball glove as defined in claim 14 wherein said vent means is formed substantially in said edge surface.

18. A baseball glove as defined in claim 14 wherein said pad surfaces rendered impervious to the flow of air by said rendering means substantially include said first and second opposed surfaces.

19. A baseball glove as defined in claim 14 wherein said rendering means includes a material impervious to the flow of air applied to the major portion of said pad surfaces for preventing the flow of air therethrough.

20. A baseball glove as defined in claim 14 wherein said vent means includes a vent material pervious to the flow of air applied along at least one of said pad surfaces.

21. A baseball glove as defined in claim 14 wherein said open cell foam material has a density of approximately one pound per cubic foot.

22. A baseball glove comprising:

(a) a flexible front panel having an inner ply and an outer ply;

(b) a flexible back panel joined to said front panel, said front and back panels defining a pocket formed to receive a hand; and (c) a pad of open cell foam material disposed between said inner and outer plies, said pad being flexible for substantially absorbing the force of impact of a ball striking said pad and sufficiently pliant for manipulation of said glove by a wearer upon application of minimal force to said glove by the wearer, said pad having first and second opposed surfaces and an edge surface, a material impervious to the flow of air extending across a major portion of said pad surfaces, a vent material formed in at least one of said pad surfaces for providing passage for air therethrough at a rate such that in response to the impact of a ball on said pad, air travels from the point of impact through said open cell foam material and is released from said pad through said vent material at a rate allowing said pad to absorb the force of said impact.

23. A baseball glove as defined in claim 22 wherein said pad is formed and positioned between said inner and outer plies for covering the palm of a hand inserted into said pocket, said pad further being formed and positioned for at least partially extending along at least one of the fingers of said hand.

24. A baseball glove as defined in claim 22 wherein said impervious material is bonded to said open-cell foam material.

25. A baseball glove as defined in claim 22 wherein said impervious material substantially extends across said first and second opposed surfaces.

26. A baseball glove as defined in claim 22 wherein said impervious material is a nylon material.

27. A baseball glove as defined in claim 22 wherein said vent material is formed in said edge surface, thereby providing a passage for the flow of air substantially along said edge surface.

28. A baseball glove as defined in claim 22 wherein said open-cell foam material has a density of approximately one pound per cubic foot.

* * * * *